United States Patent [19]

Tracey

[11] Patent Number: 4,762,969

[45] Date of Patent: Aug. 9, 1988

[54] REMOTELY PRESSURE-OPERABLE ELECTRICAL SWITCH

[75] Inventor: Peter M. Tracey, Bury St. Edmonds, United Kingdom

[73] Assignee: Bestquint Limited, Edmonds, England

[21] Appl. No.: 932,230

[22] Filed: Nov. 18, 1986

[51] Int. Cl.[4] ..... H01H 35/34

[52] U.S. Cl. ..... 200/81.4; 200/82 C; 200/83 J; 73/745

[58] Field of Search ..... 200/81 R, 81.4, 82 C, 200/82 R, 82 D, 83 R, 83 J, 83 WM, 153 L, 153 LA, 153 LB, 153 T, 156, 318, 324, 325; 340/626; 92/5 R, 101; 73/717, 723, 745

[56] References Cited

U.S. PATENT DOCUMENTS

| | | | |
|---|---|---|---|
| 3,172,981 | 3/1965 | Loesch | 200/156 |
| 3,937,912 | 2/1976 | Martin | 200/82 C |
| 4,150,264 | 4/1979 | Lieberman | 200/82 R |
| 4,263,486 | 4/1981 | Taylor | 200/153 L |
| 4,317,971 | 3/1982 | Roth | 200/83 J |

FOREIGN PATENT DOCUMENTS

| | | | |
|---|---|---|---|
| 2318973 | 10/1974 | Fed. Rep. of Germany | 200/82 C |

*Primary Examiner*—G. P. Tolin

*Attorney, Agent, or Firm*—Burgess, Ryan & Wayne

[57] ABSTRACT

A pressure operated switch has a bistable or multi-stable latching mechanism disposed between a bellows unit and an electrical switch. The latching mechanism has two relatively axially moveable elements which extend and contract with subsequent operations of the bellows unit to provide the bistable action.

12 Claims, 2 Drawing Sheets

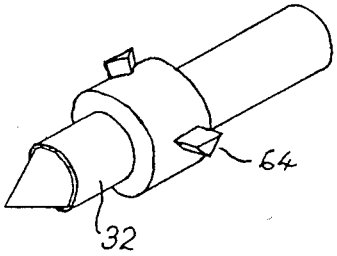
FIG. 2
FIG. 3
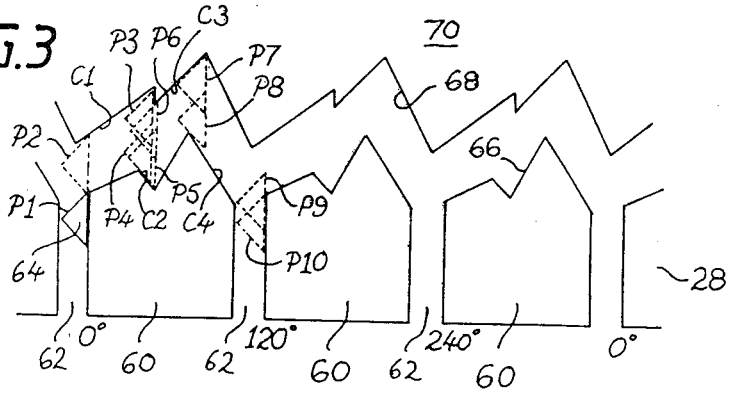
FIG. 4
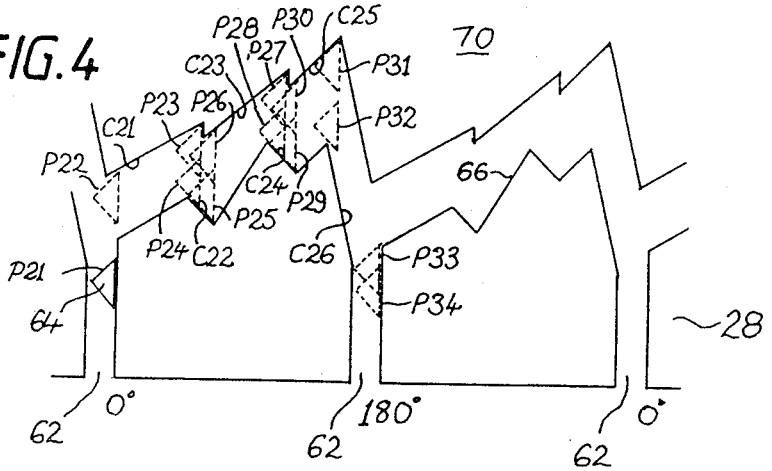

REMOTELY PRESSURE-OPERABLE ELECTRICAL SWITCH

FIELD OF THE INVENTION

This invention relates to pressure switches.

BACKGROUND OF THE INVENTION

For safety reasons in electrically operated installations where water is present, it has been proposed to use pressure operated electrical switches which are actuated by a manually operable bellows unit connected to the pressure switch by a non-conductive small bore tube. The switch can then be located near the electrical circuitry which it controls, and the bellows unit can be located remotely from the switch.

Since pressure may be lost from the bellows unit, tube or switch if they remain pressurized for a long time, it has been proposed to employ a bistable mechanism in the switch, so that one pulse of pressure changes the state of the switch and a subsequent pulse reverts the switch to its original state. The previously proposed bistable mechanism involves use of a lever connected to a bellows of the pressure switch which is connected to a crank mounted by a ratchet on a shaft. Thus repeated operations of the bellows index round the shaft. The shaft has a detent mechanism to make its indexing more positive. One or more cams are mounted on the shaft and operate the push-buttons of one or more microswitches. Thus, as the shaft is indexed around, the states of the microswitches are changed.

Problems with this arrangement are that the mechanism is complicated, and despite the use of the detent mechanism, the shaft may not index around properly.

SUMMARY OF THE INVENTION

An object of the invention is to provide a pressure switch which does not have an unduly complicated bistable mechanism and yet which provides reliable and positive operation.

In accordance with one aspect of the invention, there is provided a pressure switch comprising chamber means defining a variable volume chamber to receive pressure pulses from an actuator, the variable volume chamber having a movable wall; an electrical switch having an actuator element movable to change the state of the switch; and a mechanism for transmitting motion from the movable wall to the actuator element to change the state of the switch upon a first movement of the movable wall and to change back the state of the switch upon a repeat movement of the movable wall; characterised in that the mechanism comprises first and second axially movable elements and latch means operable to hold the elements in a first relative axial position after one movement of the movable wall and to release the elements after a subsequent movement of the movable wall.

There follows a description by way of example of specific embodiments of the present invention, reference being made to the accompanying drawings.

BRIEF DESCRIPTION OF THE DRAWINGS

FIG. 2 is a perspective view of a latch element of the switch assembly;

FIG. 3 is a development of a cylindrical section surface denoted by chain-dot lines 3 in FIG. 1; and FIG. 4 is a similar development but of a modified switch assembly.

DESCRIPTION OF THE PREFERRED EMBODIMENTS

Figure 1:
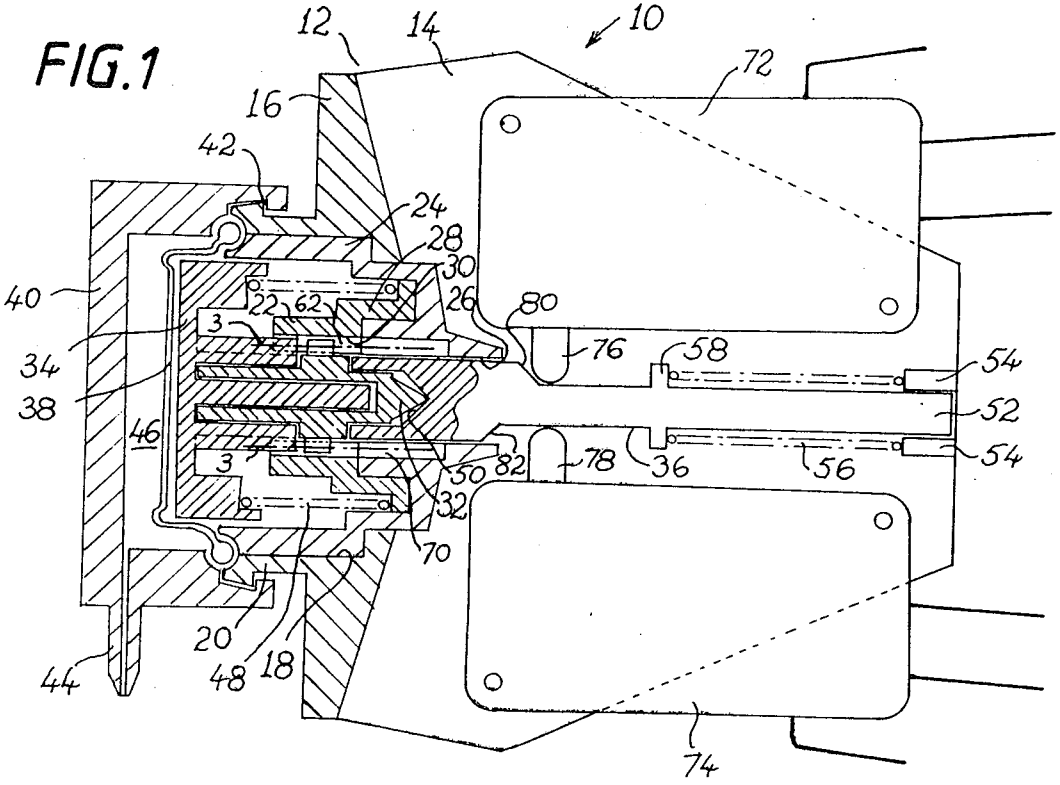
FIG. 1 is a sectioned plan view of a pressure switch assembly.

Referring to FIG. 1, a pressure switch assembly 10 has main body member 12 comprising a base plate portion 14 and an upstanding wall 16 formed with a stepped cylindrical opening 18 and an integral collar 20.

A mechanism 22 is fitted in the opening 18 and comprises a cup shaped member 24 having a central opening 26, a top-hat shaped member 28 disposed in the cup member 24 and having a central opening 30 therethrough, and a latch member 32 slidable in the opening 30 in the top-hat member 28. The mechanism 22 operates between a piston 34 and a switch actuator rod 36.

The piston 34 is covered with a diaphragm 38 the periphery of which sealingly engages between the collar 20 and cup member 24 on the one hand and a cover member 40 on the other hand. The cover member and collar 20 have complementary snap engaging formations 42 to hold the cover member 40 in place. The cover member 40 also has an integral nipple 44 for connecting a plastics tube in communication with a variable volume chamber 46 formed by the cover member 40 and the diaphragm 38. A compression coil spring 48 extends between the piston 34 and the top-hat member 28, and when pressure is applied via the nipple 44 the chamber 46 expands and the piston 34 moves to the right, as seen in FIG. 1, against the action of the spring 48.

The latch member 32 has a pointed end which engages in a recess 50 in one end of the actuator rod 36. The other end of the rod 36 has a square section portion 52 which is slidable between two guide elements 54 integral with the base plate portion 14. A compression coil spring 56 encircles the square section portion 52 and engages between the guide elements 54 and an integral collar 58 on the actuator rod 36 to urge the actuator rod to the left as viewed in FIG. 1 to hold the recess 50 in engagement with the pointed end of the latch member 32.

Referring to FIG. 3, the opening 30 through the top-hat member 28 has three splines 60 to define three axial passageways 62 spaced apart by 120 degrees.

Referring to FIG. 2, the latch member 32 has three radial projections 64 of triangular shape which are also spaced by 120 degrees and which can slide along the spline passageways 62 and move from one passageway to the next past the upper ends 66 of the splines 60 (as viewed in FIG. 3) upon rotation of the latch member 32.

Referring to FIG. 3, the ends 66 of the splines are specially shaped cams, as too is the axially facing end 68 on the inside of a central boss 70 of the cup member 24. FIG. 3 shows in dotted lines the progress of one of the triangular projections 64 as it travels from one spline passageway to the next. This is caused under the action of the piston 34 in the case of movement to the right as seen in FIG. 1 and upwardly as seen in FIG. 3 and the action of the springs 48, 56 which moves the latch member 32 to the left as seen in FIG. 1 and downwardly as seen in FIG. 3.

With the one projection 64 which is being described initially being in position P1 in FIG. 3, action of the piston moves upwardly to a position P2, where it engages a cam portion C1 which causes it to rotate until a limiting position P3 is reached. Upon release of pressure, action of the spring moves the projection to a position P4, where it engages cam portion C2 which causes it to rotate slightly until it reaches a limiting position P5. Action of the piston can then move the projection upwardly to a position P6 where it engages a cam portion C3, which causes it to rotate until a limiting position P7 is reached. Under action of the spring, the projection can then move downwardly to a position P8 where it engages a cam portion C4 which causes it to rotate until it reaches the next spline passageway at a position P9, whence the projection can move into the passageway to reach a position P10 which corresponds to original position P1 but in the next spline passageway angularly displaced by 120 degrees.

Referring to FIG. 1, a pair of change-over microswitches 72, 74 are mounted on the base plate portion 14 on opposite sides of the actuator rod 36. Each microswitch has a press-button 76, 78 engageable with a cam portion 80, 82 on the actuator rod. The cam portion 80 is arranged such that with the projections 64 in the positions P1/P10 and P9, the press-button 76 is not depressed and with the projections 64 in the positions P2 to P8, it is depressed. The cam portion 82 is arranged such that with the projections in the positions P1/P10, P2, P4, P5 and P9, the press-button 78 is not depressed sufficiently to operate the microswitch, but with the projections in the positions P3 and P6 to P8, it is depressed sufficiently to operate the microswitch.

It will be noted that positions P1/P10 and P5 are stable positions of the latch element 32. Thus, starting at position P1, a pulse of pressure applied to the chamber 46 will cause a change-over of the microswitch 72 and a momentary change-over of the microswitch 74. A further pulse will cause change-over of the microswitch 72 and a momentary change-over of the microswitch 74.

The actuator rod 36 may be modified so that the cam portion 82 is disposed at the same position along the rod as the cam portion 80. The arrangement will then provide change-over of each microswitch for each pulse of pressure applied to the chamber 46, without any momentary change-over, and thus act as a two-pole change-over switch.

FIG. 4 shows a modified arrangement of the cammed boss 70 and cammed top-hat member 28. With this arrangement a modified latching member is used having only two triangular projections 64. The FIG. 4 arrangement provides an extra stage of latching. From an initial position P21, the projection moves up to a position P22 and engages a cam portion C21, the projection turning until it reaches a limiting position P23. The projection can then move downwardly to a position P24 and then turn on a cam portion C22 until a stable limiting position P25 is reached. The projection can then move upwardly to a position P26 and then turn on a cam portion C23 until a limiting position P27 is reached, whence the projection can then move downwardly to a position P28 and turn on a cam portion C24 until a stable limiting position P29 is reached. The projection can then be moved upwardly to a position P30 and then be turned by a cam portion C25 until a limiting position P31 is reached. The projection can then move downwardly to a position P32 and can be turned by a cam portion C26 until it reaches a position P33 where the projection can enter the spline passageway 62 disposed 180 degrees from the initial position P21.

It will be noted that positions P21/P34, P25 and P29 are stable positions of the latch element 32 and are spaced up-and-down as seen in FIG. 4, or left and right as seen in FIG. 1.

The cam portions 80, 82 of the actuator rod are arranged so that, starting at the position P21, a first pulse of pressure applied to the chamber 46 will cause a change-over of the microswitch 72 (the position P25 being reached); a second pulse will cause a change-over of the microswitch 74 (the position P29 being reached); and a third pulse will cause both of the microswitches 72, 74 to change-over (reverting to their initial states, the position P34 being reached).

It will be appreciated that other modifications may be made to the arrangements described above. For example, a fourth stable state may be added corresponding to the second state, so that the following action is obtained:

| State of actuator rod 36 | State of microswitch 72 | State of microswitch 74 |
|---|---|---|
| 1 | 0 | 0 |
| 2 | 1 | 0 |
| 3 | 1 | 1 |
| 4 | 1 | 0 |
| 1 | 0 | 0 |

one pressure pulse being needed to change the state of the actuator rod.

In a simplified version of the switching arrangement only one microswitch is used, and the mechanism provides a bistable action.

What is claimed is:

1. A pressure switch comprising chamber means defining a variable volume chamber to receive pressure pulses from an actuator, the variable volume chamber having a movable wall; an electrical switch having first and second states and an actuator element movable to change the state of the switch; and a mechanism for transmitting motion from the movable wall to the actuator element to change the state of the switch; and a mechanism for transmitting motion from the movable wall to the actuator element to change the state of the switch upon a first movement of the movable wall and to change back the state of the switch upon a repeat movement of the movable wall; characterised in that the mechanism comprises first and second relatively axially movable elements and latch means operable to hold the elements in a first relative axial position corresponding to the first state of the switch after one movement of the movable wall and to release the elements to a second relative axial position corresponding to the second state of the switch after a subsequent repeat movement of the movable wall.

2. A switch according to claim 1, wherein the latch means comprises engageable cam portions provided on the first and second elements.

3. A switch according to claim 2, and further comprising a third element having cam portions engageable with cam portions on the second element.

4. A switch according to claim 3, wherein the first and third elements are stationary relative to each other and the second element is rotatable relative to the first and third elements in addition to being axially movable relative thereto.

5. A switch according to claim 4, wherein the cam portions of the second and third elements are operable to rotate the second element in one direction upon axial movement of the second element in one direction, and the cam portions of the second and first elements are operable to rotate the second element in said one direction of rotation upon axial movement of the second element in a direction opposite to said one direction of axial movement.

6. A switch according to claim 1, wherein there are two stable relative axial positions of the first and second elements.

7. A switch according to claim 1, wherein there are three stable relative axial positions of the first and second elements.

8. A switch according to claim 1, wherein there are four stable relative axial positions of the first and second elements.

9. A switch according to claim 1, further comprising an actuator member disposed between the second element and the actuator element of the switch and axially slidable with the second element.

10. A switch according to claim 9, wherein the actuator element of the switch is mounted for movement transversely of the direction of sliding of the actuator member, the actuator member having a cam portion for engaging the actuator element of the switch and transmitting motion from the actuator member to the actuator element.

11. A switch according to claim 10, and further comprising a further switch having an actuator element engageable with a further cam portion of the actuator member.

12. A pressure switch comprising:

chamber means (38, 40) defining a variable volume chamber (46) to receive pressure pulses (via 44) from an actuator, the variable volume chamber having a diaphragm (38) movable forwardly-and-rearwardly along a first axis in response to such pressure pulses;

an electrical switch (72) having first and second states and having an actuator element (76) movable to change the state of the switch; and a mechanism (22) for transmitting motion from the diaphragm to the switch upon a first forward-and-rearward movement of the diaphragm and to change back the state of the switch upon a subsequent forward-and-rearward movement of the diaphragm;

the mechanism comprising:

a latch element (32) which is movable forward-and-rearward along said axis in response to movement of the diaphragm and which is rotatable about said axis, the element having rearward (at P1/P10) and forward (at P5) stable positions corresponding to the first and second states, respectively of the switch, the latch element having a radial projection (64); and cam means (C1, C2, C3, C4) for guiding the projection (64) such that:

(a) upon a forward-and-rearward movement (P1, P2, P3, P4, P5) of the latch element from the rearward stable position (at P1) thereof, the cam means (C1, C2) (i) causes the latch element (32) to rotate to one angular position (at P5) and (ii) engages the projection (64) in said one angular position (at P5) of the latch element to prevent rearward movement of the latch element past the forward stable position (at P5) thereof; and (b) upon a forward-and-rearward movement (P5, P6, P7, P8, P9, P10) from the forward stable position (at P5) thereof, the cam means (C3, C4) (i) causes the latch element (32) to rotate to a further angular position (at P10) and (ii) permits the latch element to move to the rearward stable position thereof in the further angular position.

* * * * *